United States Patent [19]

Batra

[11] 4,063,371

[45] Dec. 20, 1977

[54] AIR-FLOW SHOE

[75] Inventor: Vijay Batra, Brockton, Mass.

[73] Assignee: Morse Shoe, Inc., Canton, Mass.

[21] Appl. No.: 687,252

[22] Filed: May 17, 1976

[51] Int. Cl.[2] ..... A43B 7/06

[52] U.S. Cl. ..... 36/3 B

[58] Field of Search ..... 36/3 R, 3 B, 114, 87, 36/32 R

[56] References Cited

U.S. PATENT DOCUMENTS

| | | | |
|---|---|---|---|
| 2,030,545 | 2/1936 | Schulze | 36/3 B |
| 2,884,716 | 5/1959 | Shelare et al. | 36/3 B |
| 3,383,782 | 5/1968 | McGinnity | 36/3 A |

FOREIGN PATENT DOCUMENTS

| | | | |
|---|---|---|---|
| 584,517 | 10/1958 | Italy | 36/3 B |

*Primary Examiner*—Patrick D. Lawson

*Attorney, Agent, or Firm*—Wolf, Greenfield & Sacks

[57] ABSTRACT

A vented shoe having a conventional upper. An outer sole of flexible compressible material engages the periphery of the upper. A series of fluid passages extend through the outer sole from concavities formed in the outer surface of the outer sole. These fluid passages are continuous with larger openings formed in a filler overlying the inner surface of the outer sole, and with holes formed in the inner sole. The concavities are preferably formed and defined by annular grooves extending inwardly from the outer surface of the outer sole in a regular repeat pattern. Preferably ribs are formed on the outer surface of the outer sole coaxial with the concavities.

20 Claims, 11 Drawing Figures

AIR-FLOW SHOE

BACKGROUND OF THE INVENTION

Athletic footwear generally tends to be uncomfortable when used for strenuous athletics over a long period of time. This uncomfortable feeling is often caused by the body heat and the consequent perspiration of the wearer's foot, that is built up and retained in the footwear. The normal confining nature of most athletic footwear accentuates these conditions. For example, in basketball and tennis footwear, the upper is normally made of leather or canvas integral with a rubber or synthetic plastic sole. Although leather and canvas uppers do have some porosity which will allow "breathing," such "breathing" is generally insufficient to provide the desirable comfort when the footwear is used for normal athletic purposes.

Attempts have been made to enhance the breathability of footwear by modifying the upper. In some cases, the upper is made with several eyelets in the instep to allow air into and out of the footwear. In other cases open weave uppers have been used. Insofar as known, few or no modifications have been made to the shoe sole to enhance ventilation of athletic footwear.

Eyelets in the instep region of the shoe upper do not provide completely satisfactory results. It is believed that eyelets in the instep region do not allow air to circulate under the sole of the foot where perspiration is significant. Nor do the eyelets in the instep region of athletic footwear provide a positive force for circulating air into the footwear. In addition, such eyelets are often inconsistent with the aesthetic design of the footwear since they are normally visible when the footwear is worn.

Open mesh uppers also limit the range of possible foot-wear designs and therefore have limited commercial value. In addition, mesh or netting type uppers do not afford as much protection and may wear more poorly than leather or solid canvas uppers.

For these and other reasons there is a need for athletic footwear with improved means of circulating drying and cooling air in the footwear. In addition, there is also a need for athletic footwear with improved sole gripping qualities.

SUMMARY OF THE INVENTION

It is an object of the present invention to provide an improved vented footwear designed particularly for use as an athletic shoe or sneaker. More specifically, it is an object of the present invention to provide athletic footwear which overcomes and meets many of the limitations described above and which are inherent in previously available athletic footwear. Footwear embodying the present invention, for use in intensive athletic events, is designed for improved air circulation between the sole of the wearer's foot and the bottom of the shoe.

It is also an object of the present invention to provide an improved athletic footwear of flexible design with a sole that is light and comfortable and has a surface with improved gripping or non-skid qualities. A further object of the present invention is to provide footwear in which air is circulated through the sole of the shoe and underneath the sole of the wearer. The quantity of air circulated is intended to be essentially proportional to the intensity with which the shoe is used for athletic purposes.

A further object of the present invention is to provide a means and method of dynamically forcing air from the outside of the shoe through the shoe sole into the interior of the shoe and to disperse the air through a filler, insole, and sock lining.

A still further object of the present invention is to provide an improved distribution system for conveying air forced through the outer sole of a shoe over a wide area beneath the foot of the wearer.

Still another object of the present invention is to provide an improved athletic footwear having a cushioned insole of resilient compressible material having an integral arch and wedge and water absorbent surface which is adapted to pass air through multiple perforations from the bottom surface to the fabric sock lining.

One more object of the present invention is to provide an inner sole designed to functionally engage a perforated filler in a manner which does not require cementing and which permits ready removal of the inner sole.

A further object of this invention is to provide footwear which provides easy access, for cleaning purposes, to the ventilation system herein described.

Another object of this invention is to provide an improved means and method for circulating air about the foot of a person as the person is actively engaged in athletic efforts.

The foregoing objects of the present invention are attained in part by providing a vented shoe having a shoe upper of conventional upper material. An outer sole of flexible compressible material engages the periphery of the upper and is formed with an outer surface having a plurality of concavities. Each of the concavities in the outer surface of the outer sole is aligned with a passage that extends through the outer sole to its inner surface. A filler has a plurality of apertures aligned with the fluid passages in the outer sole. An inner sole has a plurality of holes through it that are respectively aligned with the apertures of the filler. In a preferred embodiment a plurality of annular grooves are coaxial with the means defining the concavities in a continuous or repeat pattern over the outer sole surface. A fabric sock lining covers the inner sole, and is preferably provided with a series of holes aligned with the holes of the inner sole. When this footwear is used, the pressure of the wearer's foot on the sole compresses the concavity against the surface upon which the footwear is then located, so that air is forced from the concavity through the passages in the sole, through the aligned apertures and holes, and into the interior of the shoe, beneath the wearer's foot.

These and other objects and advantages of the present invention will be more clearly understood from a consideration of the drawings.

DETAILED DESCRIPTION OF PREFERRED EMBODIMENT

Figure 3:
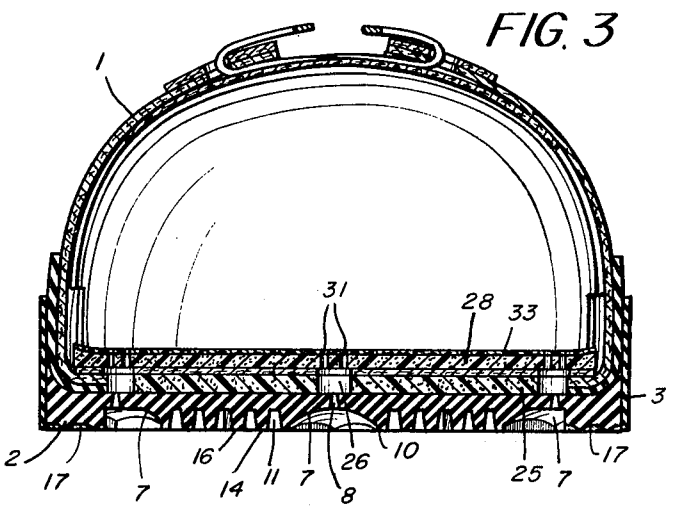
FIG. 3 is a cross-sectional view taken along the line 3—3 of FIG. 1.

Referring first to the embodiment shown in FIGS. 1 through 5, there is illustrated an athletic shoe designed especially for use by tennis players. In this arrangement a conventional tennis shoe upper 1 is integrally joined to an outer sole 2 at the periphery 3 of the outer sole. The upper 1 may be of conventional canvas or like fabric such as nylon or, as is popular in current style tennis shoes, of leather. The upper 1 and outer sole 2 may be provided with a conventional foxing strip 4.

Figure 1:
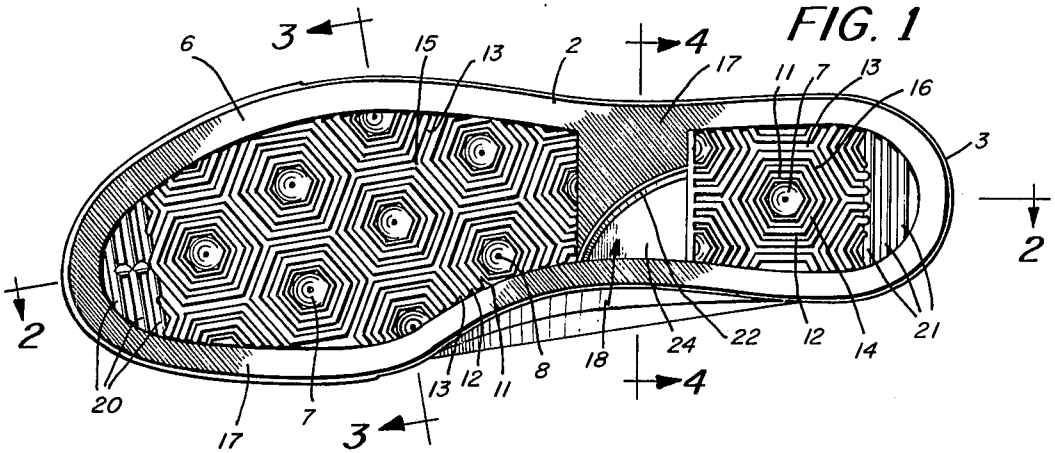
FIG. 1 is a plan elevation of the bottom of an athletic shoe embodying my invention.
Figure 2:
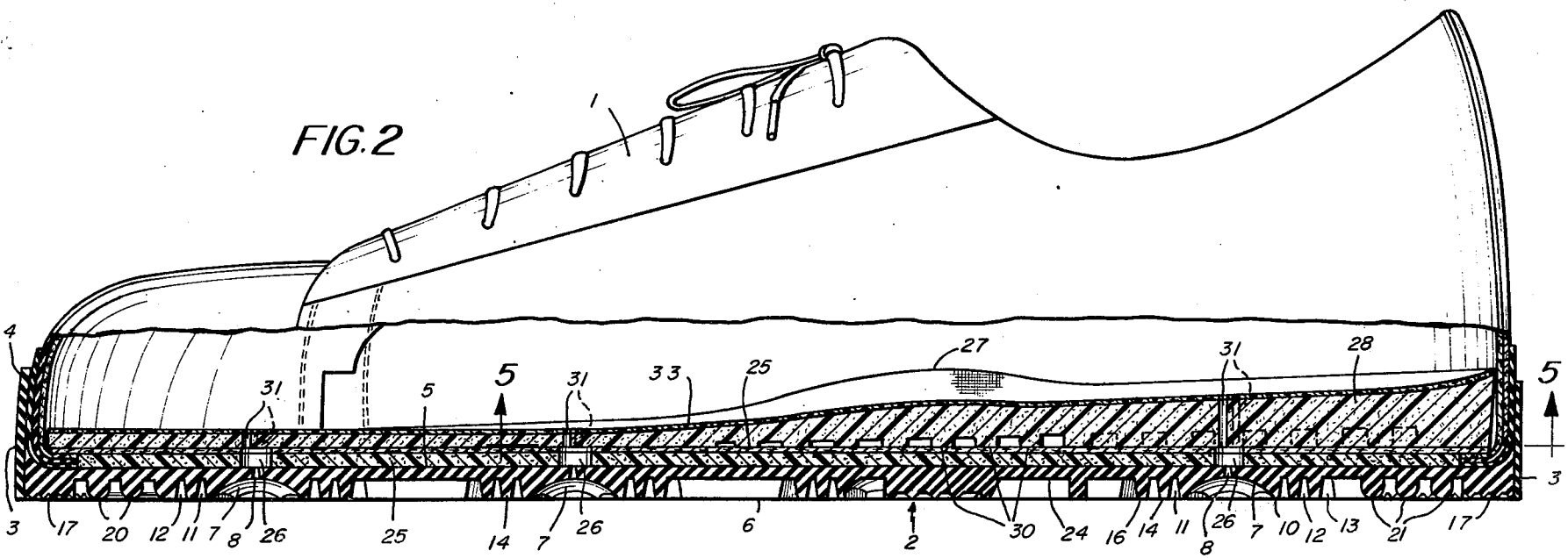
FIG. 2 is a cross-sectional view of the embodiment shown in FIG. 1 taken along the line 2—2 of FIG. 1.
Figure 4:
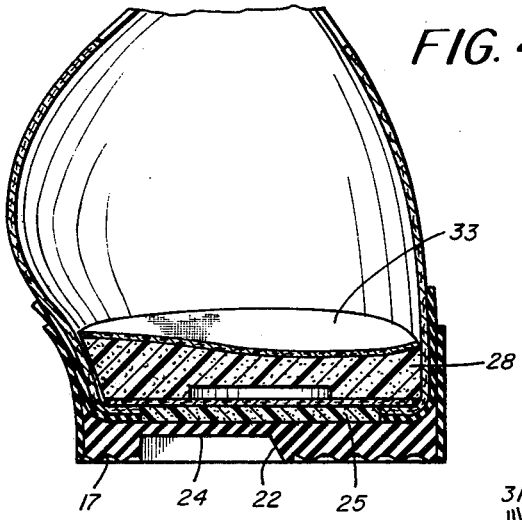
FIG. 4 is a cross-sectional view taken along the line 4—4 of FIG. 1.

The outer sole 2 is in the embodiment illustrated in FIGS. 1 through 4 has a smooth inner surface 5. The outer surface 6 has a plurality of concavities 7. Coaxial with these concavities 7 are fluid passages 8. The fluid passages 8 are preferably of the order of one or 2 millimeters in diameter. The passages 8 are flared slightly outwardly on both the inner and outer surfaces of the outer sole to provide a center annular segment in the passages which is more constricted than the periphery of the passages at the inner and outer surfaces. The periphery of each concavity 7 is uniplanar as indicated at 10 so that the concavity may be sealed at its periphery when the outer sole is pressed against the floor. Each concavity 7 is preferably dome or essentially conic shaped and defines a closed chamber when the periphery 10 of the concavity is pressed against the floor. Each concavity 7 is also defined by an annular groove 11. The annular groove in a preferred form is polyhedric in plan view as illustrated in FIG. 1. As illustrated, the specific preferred polyhedric shape is hexagonal. Concentric with the groove 11 is a series of additional grooves 12 and 13. Groove 12 is similar in cross sectional configuration to groove 11 and defines with it the hexagonal wall 14. The sides of wall 14 are diverging from the outer surface 6. Groove 13 is approximately three millimeters in width and is thereby about three times the width of grooves 11 and 12. Groove 13 is interconnected with like grooves that are coaxial with the other concavities, as is illustrated at 15 for example. Groove 13 defines with groove 12 a second annular rib 16 parallel to rib 14.

The pattern of concavities 7 is repeated over the sole portion of the shoe from a marginal section 17 on one side to a continuation of the same marginal section 17 on the other side and from a position short of the toe end of the sole to the instep region 18. A single concavity 7 is located in the heel portion within the periphery 17. At the forward or toe end of the sole a plurality of transverse ribs 20 are formed parallel to one another with an arcuate cross section. A similar configuration of ribs 21 are formed at the heel end of the sole. At the instep area of the sole, the periphery 17 extends inwardly to an arcuate section 22. A thin arcuate segment 24 is formed between the arcuate section 22 and the opposite portion of the periphery 17.

A filler of fibrous material 25 is positioned within the upper against the inner surface of the outer sole. This filler may be formed of any fibrous material or a laminate of several, as illustrated, as is conventional used for footwear construction. A plurality of apertures 26 of about five to ten millimeters in diameter are formed in the filler. Each aperture 26 is in alignment with a passage 8. The fibrous filler 25 is preferably in the order of 5 millimeters in thickness and should be of uniform thickness over its entire surface.

Figure 5:
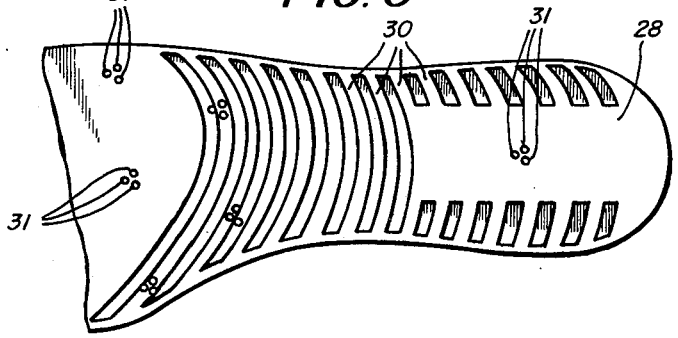
FIG. 5 is a partial plan elevation of the lower surface of the inner sole of the embodiment shown in FIG. 1.
Figure 6:
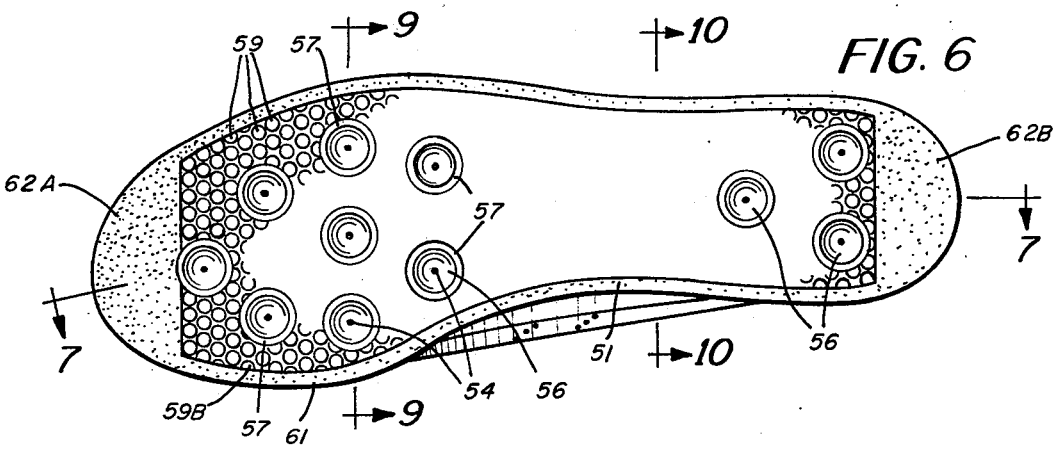
FIG. 6 is a plan elevation of the bottom of an athletic shoe which is a second embodiment of my invention.
Figure 8:
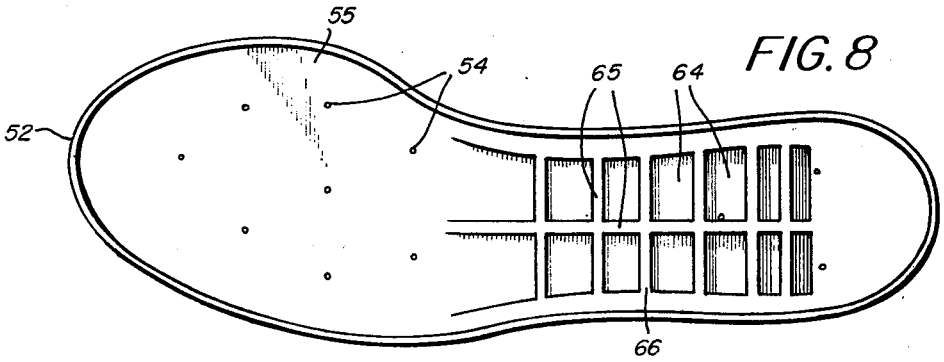
FIG. 8 is a top plan elevation of the outer sole of the embodiment shown in FIG. 6.

Positioned within the shoe is an inner sole of foam rubber or the like. In the preferred embodiment the inner sole is formed with an integral arch and wedge 27 and 28 respectively. The lower surface of the inner sole is provided with a series of ribs extending transversely of the lower surface of the inner sole in an arcuate configuration from one side to the other with a curve slightly following the heel portion of the inner sole. These ribs 30, as shown in FIG. 5, are designed to frictionally engage the upper surface of the fiber filler to prevent skidding or movement of the inner sole without requiring cementing of the inner sole. Preferably, the inner sole is removable so that the user can keep the passages 8 and apertures 26 free of debris. A plurality of holes 31 is formed in the inner sole. These holes, in groups of three or more, are aligned with the apertures 26 and passages 8, respectively, of the filler and outer sole. The holes 31 extend over an area as great as the area of the apertures 26, and the apertures 26 in turn have a wider diameter than the fluid passages 8. Overlying and preferably cemented to the inner sole is a fabric sock lining 33 which also has holes aligned with the holes 31 of the inner sole.

Referring now to the embodiments of FIGS. 6 through 10, there is illustrated a basketball shoe embodying the present invention. In this embodiment the upper 50 is formed in a conventional fashion of conventional material. The upper 50 is suitably interengaged with the outer sole 51 at the periphery 52 of the outer sole. The outer sole 51 and its periphery 52 are integrally formed with the periphery 52 comprising a flange integrally molded with the outer sole and lying substantially normal to the major plane of the outer sole. If desired, a groove 53 may be formed about the outer surface of the flange 52. This flange 52 provides a surface upon which a conventional foxing strip may be adhered if desired.

The outer sole 51 is vented with a plurality of fluid passages 54. These fluid passages 54 are preferably uniform in diameter along their length. The passages extend from the outer surface of the outer sole 51 to the inner surface 55 of the outer sole. Concavities 56 ar respectively aligned with each of the fluid passages 54. These concavities 56 are defined by upstanding circular projecting members 57 which project from the major plane 58 of the outer surface of the outer sole. In the preferred embodiment, for basketball use, eight of such concavities are provided in the forward part of the shoe and three in the heel region. A plurality of cylindrical bosses 59A and 59B having a diameter approximately one-half the diameter of the concavity 56 project from the major plane 58 of the outer sole outwardly. One set 59A of about one half project to a plane that is coplanar with the plane in which the periphery 57 of the concavities terminate. The others 59B which are longer than the bosses 59A, project to a second common plane. These bosses 59A, 59B are closely spaced together and cover the major surface of the outer sole except for those portions in which the concavities are formed and the toe and heel regions of the outer sole. By providing a plurality of these spaced bosses 59A, 59B between and around the various concavities the compressibility of the concavities when pressed against a flat surface is enhanced. The efficiency of the pumping of air through the passage 54 is thus increased when a concavity 56 is in compressed engagement with a flat surface. This design thus enhances ventilation, and therefore cooling and drying, of the wearer's feet when this footwear is used. The periphery 61 of the outer surface of the outer sole 51 and toe section 62A and heel section 62B have a roughened surface. These are coplanar with one set of the outer ends of the bosses 59.

Figures 7, 9, 10, 11:
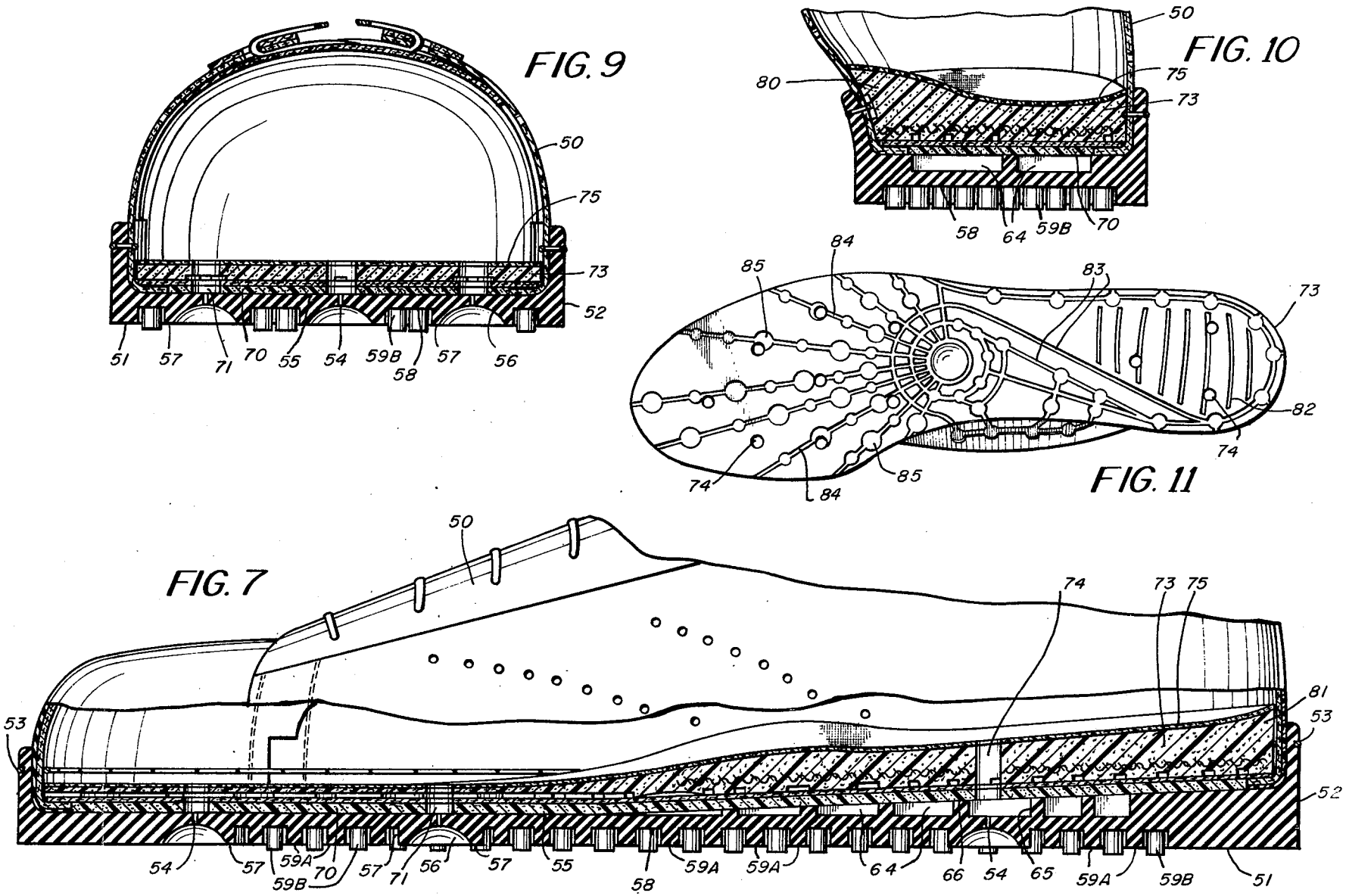
FIG. 7 is a cross-sectional view of the embodiment shown in FIG. 6 taken along the line 7—7 of FIG. 6.
FIG. 9 is a cross-sectional view taken along the line 9—9 of FIG. 6.
FIG. 10 is a cross-sectional detail taken essentially along the line 10—10 of FIG. 6.
FIG. 11 is a plan elevation of the lower surface of the inner sole of the embodiment shown in FIG. 6.

A plurality of rectangular recesses 64 are formed on the inner surface 55 of the outer sole from the instep to the heel region with the walls 65 that form these recesses having an inner surface 66 that is continuous with the inner surface 55 of the outer sole. The heel portion of the outer sole is thicker than the toe portion, with this thicker heel portion tapering as illustrated in FIG. 7 toward the toe portion. A fibrous absorbent filler 70 of uniform thickness is positioned over the inner surface of the outer sole with apertures 71 aligned with the passages 54. The apertures 71 are of a greater diameter than the diameter of the passages 54.

An inner sole 73, similar in structural concept to the inner sole illustrated in FIGS. 1 through 5, is positioned in a like manner over the fiber filler 70 with its apertures or holes 74 suitably located in alignment with the apertures 71 and the passages 54. The inner sole 73 like that shown in FIG. 5 is formed with an integral arch 80 and wedge 81. The lower surface of this inner sole has a series of arcuate indentations 82 in its heel portion as well as curvilinear indentations 83 extending from the instep side of the heel around under the arch 80. Linear indentations 84 extend substantially radially and forwardly toward the toe portion of the lower surface of the inner sole and these are interspersed with widenings 85. The lower surface 50 formed frictionally engages the upper surface of the filler 70 to prevent skidding. With this feature, no cementing is required and the inner sole is removable so that the passages 54 and apertures 71 can be kept free of debris.

A fabric sock lining 75 similar to the sock lining illustrated and described in connection with FIG. 1, overlies the inner sole 73.

Having now described my invention, I claim:

1. A vented athletic shoe comprising:

a shoe upper, an outersole of flexible compressible material engaging the periphery of said upper and having an outer surface and an inner surface, means forming a plurality of fluid passages through said outersole from said inner surface to said outer surface, and said outer surface formed with a plurality of concavities, each of said concavities respectively aligned with different ones of said passages and adapted to form a chamber from which air is forced into and through said passage associated with said chamber as the periphery of said chamber engages and is pressed toward a surface.

2. A vented shoe as set forth in claim 1 including means forming a plurality of annular grooves extending from said outer surface with each groove coaxial with one of said passages.

3. A vented shoe as set forth in claim 2 including a plurality of annular grooves coaxial with each of said passages thereby defining at least one annular rib coaxial with each of said passages.

4. A vented shoe as set forth in claim 3 including a plurality of said annular ribs.

5. A vented shoe as set forth in claim 4 wherein said annular ribs having a polyhedric configuration.

6. A vented shoe as set forth in claim 2 including a filler positioned within said shoe in facing relation to said inner surface, said filler formed of a fibrous absorbent material and having a plurality of apertures therethrough, with each aligned with one of said passages.

7. A vented shoe as set forth in claim 6 including an inner sole of resilient compressible material having a plurality of holes with each aligned in series with one of said apertures and passages.

8. A vented shoe as set forth in claim 7 wherein said inner sole includes an arch support and wedge, a plurality of ribs extending across the surface of said inner sole in facing engagement with said filler, a fabric absorbent sock lining in facing relation to the surface of said inner sole remote from said filler.

9. A vented shoe as set forth in claim 1 wherein said outer sole is integrally formed with a flange extending from the periphery of said outersole in a direction substantially normal to said outer surface, said upper and said flange interengaged.

10. A vented shoe as set forth in claim 1 including means forming a plurality of ribs in said outer surface extending transversely of said sole.

11. A vented shoe as set forth in claim 1 wherein said concavities are each formed in a member formed in said outer surface and projecting from said outer surface, said member adapted to be compressed upon application of forces normal to said outer surface.

12. A vented shoe as set forth in claim 11 wherein said members are polyhedric in shape and are arranged in said outer surface in a continuous pattern.

13. A vented shoe as set forth in claim 12 having means defining a plurality of grooves coaxial with each of said members and extending into said outersole from the outer surface thereof.

14. A vented shoe as set forth in claim 1 including a plurality of spaced bosses extending outwardly from said outer sole about said concavities and having outer ends coplanar with said periphery of said chamber.

15. A vented shoe as set forth in claim 14 wherein said bosses have a diameter approximately one-half the diameter of said concavities.

16. A vented shoe as set forth in claim 15 wherein said concavities are each formed in members projecting from the major plane of said outersole and said bosses and member being of substantially equal length.

17. A vented shoe as set forth in claim 7 further characterized by said inner sole having means provided in its lower surface to non-slippably engage said fiber filler, said inner sole being non-destructably, removably located in facing contact with said filler.

18. A vented shoe as set forth in claim 8 further characterized by said inner sole being non-destructably removable from said facing relation with said filler.

19. A vented shoe as set forth in claim 1 including two sets each having a plurality of spaced bosses extending outwardly from said outersole about said concavities, each boss having its outer end coplanar with those of the other bosses in the set to which it belongs but not with those of the bosses in the other set.

20. A vented shoe as set forth in claim 19 wherein said bosses have a diameter approximately one-half the diameter of said concavities.

* * * * *